US010887949B2

(12) United States Patent
Suzuki et al.

(10) Patent No.: US 10,887,949 B2
(45) Date of Patent: Jan. 5, 2021

(54) METHOD FOR MANUFACTURING ATOMIZING UNIT, ATOMIZING UNIT, AND NON-COMBUSTION TYPE FLAVOR INHALER

(71) Applicant: JAPAN TOBACCO INC., Tokyo (JP)

(72) Inventors: Akihiko Suzuki, Tokyo (JP); Takeshi Shinkawa, Tokyo (JP); Manabu Takeuchi, Tokyo (JP); Takuma Nakano, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 274 days.

(21) Appl. No.: 15/820,112

(22) Filed: Nov. 21, 2017

(65) Prior Publication Data

US 2018/0092402 A1 Apr. 5, 2018

Related U.S. Application Data

(63) Continuation of application No. PCT/JP2016/064929, filed on May 19, 2016.

(30) Foreign Application Priority Data

May 22, 2015 (JP) ..... 2015-064807

(51) Int. Cl.
*H05B 3/46* (2006.01)
*A24F 47/00* (2020.01)
(Continued)

(52) U.S. Cl.
CPC ..... *H05B 3/46* (2013.01); *A24F 7/04* (2013.01); *A24F 47/00* (2013.01); *A24F 47/008* (2013.01);
(Continued)

(58) Field of Classification Search
CPC ..... A24F 47/008; H05B 3/46
See application file for complete search history.

(56) References Cited

U.S. PATENT DOCUMENTS 4,987,675 A * 1/1991 Jackson ..... H05B 3/10 29/615
5,878,752 A * 3/1999 Adams ..... A24F 47/008 131/329
(Continued)

FOREIGN PATENT DOCUMENTS

CN 204146307 U 2/2015
JP 58-073985 A 5/1983
(Continued)

OTHER PUBLICATIONS

Chinese Office Action and Search Report for Chinese Application No. 201680029510.9, dated Aug. 5, 2019, with partial English translation.
(Continued)

*Primary Examiner* — Michael J Felton
*Assistant Examiner* — Taryn Trace Willett
(74) *Attorney, Agent, or Firm* — Birch, Stewart, Kolasch & Birch, LLP

(57) ABSTRACT

A method for manufacturing an atomizing unit, comprises a step A of forming an oxide film on a surface of a heating element forming a part of an atomizing unit that atomizes an aerosol source, by supplying electric power to the heating element, in a state where the heating element is processed into a heater shape.

12 Claims, 4 Drawing Sheets

(51) Int. Cl.
*A24F 7/04* (2006.01)
*C23C 18/12* (2006.01)
*H05B 3/44* (2006.01)

(52) U.S. Cl.
CPC ..... *C23C 18/1291* (2013.01); *H05B 3/44* (2013.01); *H05B 2203/014* (2013.01); *H05B 2203/017* (2013.01); *H05B 2203/021* (2013.01); *H05B 2203/035* (2013.01)

(56) References Cited

U.S. PATENT DOCUMENTS

| | | | | |
|---|---|---|---|---|
| 2004/0112893 | A1* | 6/2004 | Okuda | H05B 3/48 219/544 |
| 2013/0192615 | A1 | 8/2013 | Tucker et al. | |
| 2013/0192620 | A1* | 8/2013 | Tucker | H05B 3/0014 131/329 |
| 2014/0041655 | A1* | 2/2014 | Barron | A61M 11/042 128/202.21 |
| 2014/0190496 | A1* | 7/2014 | Wensley | A24F 47/008 131/273 |
| 2014/0253144 | A1 | 9/2014 | Novak, III et al. | |
| 2015/0164143 | A1* | 6/2015 | Maas | H05B 3/12 131/329 |
| 2016/0120229 | A1 | 5/2016 | Tucker et al. | |
| 2018/0007741 | A1* | 1/2018 | Metz | H05B 3/283 |

FOREIGN PATENT DOCUMENTS

| | | | |
|---|---|---|---|
| JP | 63-109363 | A | 5/1988 |
| JP | 64-54689 | A | 3/1989 |
| JP | 04-029154 | U1 | 3/1992 |
| JP | 3068662 | B2 | 7/2000 |
| JP | 2015-513393 | A | 5/2015 |
| TW | 201206357 | A1 | 2/2012 |
| WO | WO 2013/110210 | A1 | 8/2013 |
| WO | WO 2013/110211 | A1 | 8/2013 |

OTHER PUBLICATIONS

Yu et al., "Manual of Flame Resistant Materials," The Mass Press, Jun. 1991, pp. 538-539 (9 pages total).

Taiwanese Office Action and Search Report for Application No. 105115934, dated Oct. 23, 2017, with an English translation of the Office Action.

International Search Report for PCT/JP2016/064929 (PCT/ISA/210) dated Aug. 23, 2016.

Extended European Search Report, dated Dec. 18, 2018, for European Application No. 16799928.3.

* cited by examiner

METHOD FOR MANUFACTURING ATOMIZING UNIT, ATOMIZING UNIT, AND NON-COMBUSTION TYPE FLAVOR INHALER

CROSS REFERENCE TO RELATED APPLICATIONS

This application is a Continuation of PCT International Application No. PCT/JP2016/064929, filed on May 19, 2016, which claims priority under 35 U.S.C. 119(a) to Patent Application No. PCT/JP2015/064807, filed in Japan on May 22, 2015, all of which are hereby expressly incorporated by reference into the present application.

TECHNICAL FIELD

The present invention relates to a method for manufacturing an atomizing unit having a heating element that atomizes an aerosol source without burning, the atomizing unit, and a non-combustion type flavor inhaler.

BACKGROUND ART

Conventionally, a non-combustion type flavor inhaler for inhaling flavor without burning has been known. The non-combustion type flavor inhaler includes an atomizing unit that atomizes an aerosol source without burning. The atomizing unit has a liquid holding member that holds the aerosol source, and a heating element (atomizer) that atomizes the aerosol source held by the liquid holding member (e.g., Patent Literatures 1 and 2).

CITATION LIST

Patent Literature

Patent Literature 1: WO 2013/110210 A
Patent Literature 2: WO 2013/110211 A

SUMMARY

A first feature is summarized as a method for manufacturing an atomizing unit, comprising a step A of forming an oxide film on a surface of a heating element forming a part of an atomizing unit that atomizes an aerosol source, by supplying electric power to the heating element, in a state where the heating element is processed into a heater shape.

A second feature is summarized as the method for manufacturing the atomizing unit according to the first feature, wherein the step A is performed in a state where the heating element is neither in contact with nor close to the aerosol source.

A third feature is summarized as the method for manufacturing the atomizing unit according to the first feature or second feature, further comprising a step B of bringing a liquid holding member into contact with or close to the heating element, the liquid holding member being a member to hold the aerosol source, wherein the step A is performed in a state where the liquid holding member is in contact with or close to the heating element.

A fourth feature is summarized as the method for manufacturing the atomizing unit according to the third feature, wherein the step A is performed in a state where the liquid holding member is in contact with a reservoir that is a member to store the aerosol source.

A fifth feature is summarized as the method for manufacturing the atomizing unit according to the fourth feature, wherein the step A is performed before the aerosol source is filled in the reservoir.

A sixth feature is summarized as the method for manufacturing the atomizing unit according to any one of the third feature to fifth feature, wherein the liquid holding member has a heat conductivity of 100 W/(m·K) or less.

A seventh feature is summarized as the method for manufacturing the atomizing unit according to any one of the third feature to sixth feature, wherein the liquid holding member is made of a material having flexibility, and the heater shape is a shape of the heating element wound around the liquid holding member, and is a coil shape.

A eighth feature is summarized as the method for manufacturing the atomizing unit according to any one of the third feature to seventh feature, wherein the step A is performed in a state where the liquid holding member traverses an airflow path including a flow path of aerosol generated from the atomizing unit.

A ninth feature is summarized as the method for manufacturing the atomizing unit according to the eighth feature, wherein the step A is performed in a state where at least one end of the liquid holding member is taken outside a tubular member forming the airflow path.

A tenth feature is summarized as the method for manufacturing the atomizing unit according to any one of the first feature to the ninth feature, wherein the step A is performed in a state where the heating element is in contact with an oxidizing substance.

A eleventh feature is summarized as the method for manufacturing the atomizing unit according to any one of the first feature to the tenth feature, wherein the step A includes a step of supplying electric power to the heating element in accordance with a condition for checking an operation of the atomizing unit.

A twelfth feature is summarized as the method for manufacturing the atomizing unit according to the eleventh feature, wherein the condition is a condition that a process is performed for m times (m is an integer of 1 or more), the process applying a voltage to the heating element over 1.5 to 3.0 seconds, the voltage being a same voltage as a power source mounted on a non-combustion type flavor inhaler incorporated with the atomizing unit.

A thirteenth feature is summarized as the method for manufacturing the atomizing unit according to any one of the first feature to the twelfth feature, wherein the step A includes a step of intermittently supplying electric power to the heating element.

A fourteenth feature is summarized as an atomizing unit comprising: a heating element having a heater shape; and an aerosol source in contact with or close to the heating element, wherein an oxide film is formed on a surface of the heating element.

A fifteenth feature is summarized as the atomizing unit according to the fourteenth feature, wherein an interval between conductive members adjacent to each other among conductive members forming the heating element is 0.5 mm or less.

A sixteenth feature is summarized as the atomizing unit according to the fourteenth feature or the fifteenth feature, wherein the heater shape is a coil shape.

A seventeenth feature is summarized as a non-combustion type flavor inhaler comprising: the atomizing unit according to any one of the fourteenth feature to the sixteenth feature;

and a filter provided on an inhalation side with respect to the heating element on a flow path of aerosol generated from the atomizing unit.

DESCRIPTION OF EMBODIMENTS

Figure 1:
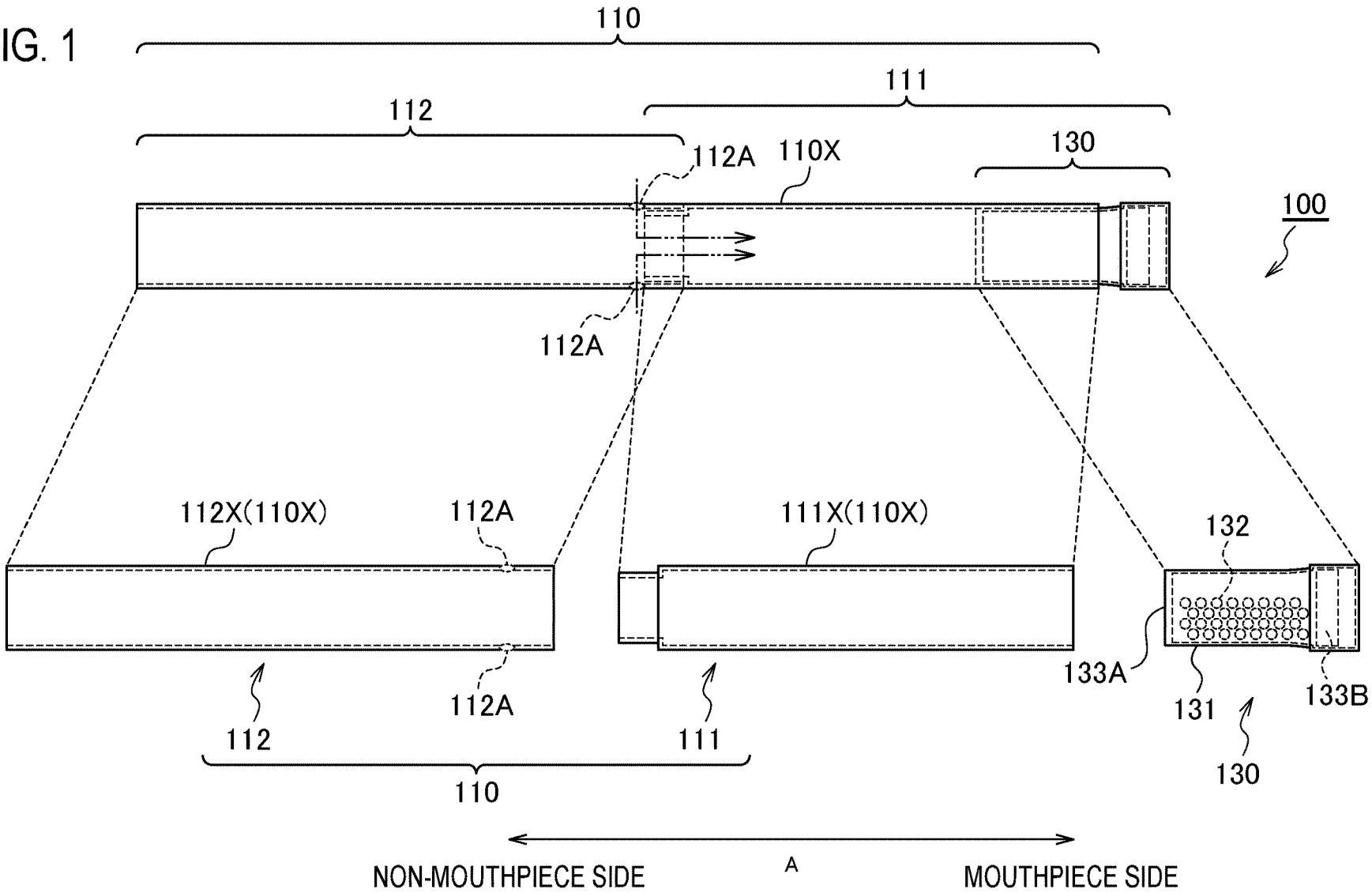
FIG. 1 is a view showing a non-combustion type flavor inhaler 100 according to an embodiment.

Hereinafter, the embodiments of the present invention will be described with reference to the drawings. In the following drawings, identical or similar components are denoted by identical or similar reference numerals.

Therefore, specific dimensions should be determined with reference to the description below. It is needless to mention that different relationships and ratio of dimensions may be included in different drawings.

Summary of Embodiment

In the atomizing unit described in the above background art, there is used a heating element processed into a heater shape. Assuming that a power output (e.g., voltage) for the heating element is constant, from a viewpoint of increasing an aerosol amount per unit power output, it is preferable to reduce an interval between mutually adjacent conductive members among conductive members forming the heating element processed into the heater shape. However, when the interval between the mutually adjacent conductive members is reduced, short-circuit of the conductive members forming the heating element is likely to occur in a manufacturing process of the heating element.

A manufacturing method for an atomizing unit according to an embodiment includes step A of forming an oxide film on a surface of the heating element forming a part of an atomizing unit that atomizes an aerosol source, by supplying electric power to the heating element, in a state where the heating element is processed into the heater shape.

In the embodiment, the oxide film is formed on the surface of the heating element by supplying electric power to the heating element in the state where the heating element is processed into the heater shape. Accordingly, while reducing the interval between the mutually adjacent conductive members among the conductive members forming the heating element, it is possible to prevent short-circuit of the conductive members forming the heating element by the oxide film formed on the surface of the heating element. Furthermore, as compared with a case where the heating element is processed into the heater shape after the oxide film is formed on the surface of the heating element, it is easy to prevent peeling of the oxide film formed on the surface of the heating element.

Embodiment (Non-Combustion Type Flavor Inhaler)

Figure 2:
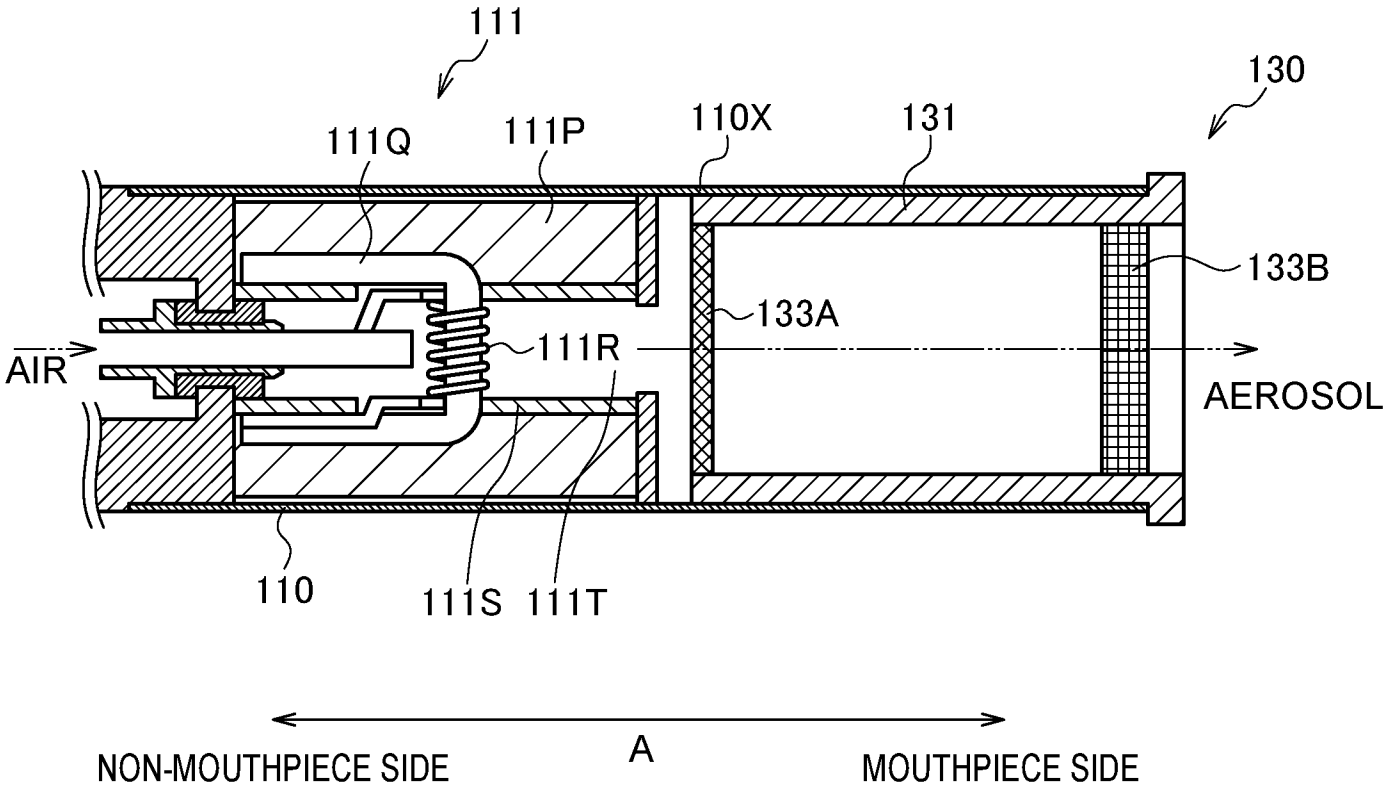
FIG. 2 is a view showing an atomizing unit 111 according to the embodiment.

Hereinafter, a non-combustion type flavor inhaler according to the embodiment will be described. FIG. 1 is a view showing a non-combustion type flavor inhaler 100 according to the embodiment. The non-combustion type flavor inhaler 100 is a device for inhaling a flavoring component without burning, and has a shape extending along a predetermined direction A that is a direction from a non-inhalation end toward an inhalation end. FIG. 2 is a view showing an atomizing unit 111 according to the embodiment. It should be noted that, in the following description, the non-combustion type flavor inhaler 100 is simply referred to as a flavor inhaler 100.

As shown in FIG. 1, the flavor inhaler 100 has an inhaler body 110 and a cartridge 130.

The inhaler body 110 forms a main body of the flavor inhaler 100, and has a shape connectable with the cartridge 130. Specifically, the inhaler body 110 has an inhaler housing 110X, and the cartridge 130 is connected to an inhalation-side end of the inhaler housing 110X. The inhaler body 110 has the atomizing unit 111 that atomizes the aerosol source without burning of the aerosol source, and a battery unit 112. The atomizing unit 111 and the battery unit 112 are accommodated in the inhaler housing 110X.

In the embodiment, the atomizing unit 111 has a first cylinder 111X forming a part of the inhaler housing 110X. As shown in FIG. 2, the atomizing unit 111 has a reservoir 111P, a wick 111Q, an atomizer 111R, and a tubular member 111S. The reservoir 111P, the wick 111Q, and the atomizer 111R are accommodated in the first cylinder 111X. The first cylinder 111X has a tubular shape (e.g., cylindrical shape) extending along the predetermined direction A.

The reservoir 111P is an example of a reservoir, which is a member to store the aerosol source. The reservoir 111P has a configuration (size, material, structure, and the like) suitable for storing the aerosol source to be used for a plurality of puffing actions. For example, the reservoir 111P may be a porous body made of a material such as a resin web, or may be a cavity to store the aerosol source. The reservoir 111P can preferably store more aerosol sources per unit volume.

The wick 111Q is an example of a liquid holding member, which is a member to hold the aerosol source supplied from the reservoir 111P. The wick 111Q has a configuration (size, material, structure, and the like) suitable for transferring a part of the aerosol source that can be stored in the reservoir 111P (e.g., the aerosol source to be used in one puffing action) to a position in contact with or close to the atomizer 111R from the reservoir 111P, to hold the part of the aerosol source. The wick 111Q may be a member that transfers the aerosol source from the reservoir 111P to the wick 111Q by a capillary phenomenon. The wick 111Q transfers the aerosol source to the wick 111Q by contacting with the reservoir 111P. When the reservoir 111P is a cavity, the contact between the wick 111Q and the reservoir 111P means that the wick 111Q is exposed to the cavity (reservoir 111P). However, it should be noted that, after the aerosol source is filled in the reservoir 111P, the wick 111Q is arranged so as to come into contact with the aerosol source filled in the cavity (reservoir 111P). For example, the wick 111Q is made of glass fiber or porous ceramic. The wick 111Q preferably has heat resistance capable of withstanding heating of the atomizer 111R.

The wick 111Q has a heat conductivity of 100 W/(m·K) or less. The heat conductivity of the wick 111Q is preferably 50 W/(m·K) or less, and more preferably 10 W/(m·K) or less.

This prevents excessive heat from being transferred from the heating element to the reservoir 111P via the wick 111Q. The wick 111Q may be made of a material having flexibility. The wick 111Q preferably has heat resistance of 300° C. or more, and more preferably has heat resistance of 500° C. or more.

The atomizer 111R atomizes the aerosol source held by the wick 111Q. The atomizer 111R is, for example, the heating element processed into the heater shape. The heating element processed into the heater shape is arranged so as to be in contact with or close to the wick 111Q holding the aerosol source. On the surface of the heating element, an oxide film is formed. Here, the heating element being close to the wick 111Q means that a distance between the heating element and the wick 111Q is maintained such that a distance between the heating element and the aerosol source is maintained to such an extent that the aerosol source can be atomized by the heating element when the wick 111Q holds the aerosol source. The distance between the heating element and the wick 111Q depends on a type of the aerosol source and the wick 111Q, temperature of the heating element, and the like. For example, a distance of 3 mm or less, and preferably a distance of 1 mm or less may be considered.

The aerosol source is liquid such as propylene glycol or glycerin. The aerosol source is held, for example, by a porous body made of a material such as a resin web as described above. The porous body may be made of a non-tobacco material, or may be made of a tobacco material. The aerosol source may contain a flavoring component (e.g., a nicotine component or the like). Alternatively, the aerosol source may not contain the flavoring component.

The tubular member 111S is an example of a tubular member forming an airflow path 111T including a flow path of aerosol generated from the atomizer 111R. The airflow path 111T is a flow path of air flowing in from an inlet 112A. Here, the wick 111Q described above is arranged so as to traverse the airflow path 111T. At least one end (both ends in FIG. 2) of the wick 111Q is taken outside the tubular member 111S, and the wick 111Q comes into contact with the reservoir 111P at a portion taken outside the tubular member 111S.

The battery unit 112 has a second cylinder 112X forming a part of the inhaler housing 110X. In the embodiment, the battery unit 112 has the inlet 112A. As shown in FIG. 2, the air flowing in from the inlet 112A is guided to the atomizing unit 111 (atomizer 111R). The battery unit 112 has a power source to drive the flavor inhaler 100, and a control circuit to control the flavor inhaler 100. The power source and the control circuit are accommodated in the second cylinder 112X. The second cylinder 112X has a tubular shape (e.g., cylindrical shape) extending along the predetermined direction A. The power source is, for example, a lithium-ion battery or a nickel hydrogen battery. The control circuit is configured by, for example, a CPU and a memory.

The cartridge 130 is configured to be connectable to the inhaler body 110 forming the flavor inhaler 100. The cartridge 130 is provided on the inhalation side from the atomizing unit 111 on the airflow path 111T. In other words, the cartridge 130 is not necessarily provided on the inhalation side from the atomizing unit 111 in terms of a physical space, but the cartridge 130 only needs to be provided on the inhalation side from the atomizing unit 111 on the airflow path 111T. That is, in the embodiment, "inhalation side" may be considered to be synonymous with "downstream" of the flow of the air flowing in from the inlet 112A, and "non-inhalation side" may be considered to be synonymous with "upstream" of the flow of the air flowing in from the inlet 112A.

Specifically, the cartridge 130 has a cartridge body 131, a flavor source 132, a mesh 133A, and a filter 133B.

The cartridge body 131 has a tubular shape extending along the predetermined direction A. The cartridge body 131 accommodates the flavor source 132.

The flavor source 132 is provided on the inhalation side from the atomizing unit 111 on the airflow path 111T. The flavor source 132 gives a flavoring component to aerosol generated from the aerosol source. In other words, the flavor given to the aerosol by the flavor source 132 is conveyed to an inhalation port.

In the embodiment, the flavor source 132 is made by a raw material piece that gives the flavoring component to aerosol generated from the atomizing unit 111. A size of the raw material piece is preferably 0.2 mm or more to 1.2 mm or less. Further, the size of the raw material piece is preferably 0.2 mm or more to 0.7 mm or less. Since a specific surface area is increased as the size of the raw material piece composing the flavor source 132 is smaller, the flavoring component is easily released from the raw material piece composing the flavor source 132. Therefore, in giving a desired amount of the flavoring component to aerosol, an amount of the raw material piece can be suppressed. As the raw material piece composing the flavor source 132, it is possible to use a shredded tobacco, and a molded body of a granulated tobacco material. However, the flavor source 132 may be a molded body formed into a sheet tobacco material. Further, the raw material piece composing the flavor source 132 may be composed of a plant other than tobacco (e.g., mint, herbs, and the like). The flavor source 132 may be given flavors such as menthol.

Here, the raw material piece composing the flavor source 132 is obtained by sieving according to JIS Z 8815, for example, by using a stainless steel sieve according to JIS Z 8801. For example, by using a stainless steel sieve having a mesh opening of 0.71 mm, the raw material pieces are sieved for 20 minutes by a dry type mechanical shaking method, providing raw material pieces passing through the stainless steel sieve having the mesh opening of 0.71 mm. Subsequently, by using a stainless steel sieve having a mesh opening of 0.212 mm, the raw material pieces are sieved for 20 minutes by a dry type mechanical shaking method, removing the raw material pieces passing through the stainless steel sieve having the mesh opening of 0.212 mm. That is, the raw material piece composing the flavor source 132 is a raw material piece that passes through the stainless steel sieve (mesh opening=0.71 mm) defining an upper limit, but does not pass through the stainless steel sieve (mesh opening=0.212 mm) defining a lower limit. Accordingly, in the embodiment, the lower limit of the size of the raw material piece composing the flavor source 132 is defined by the mesh opening of the stainless steel sieve defining the lower limit. Moreover, the upper limit of the size of the raw material piece composing the flavor source 132 is defined by the mesh opening of the stainless steel sieve defining the upper limit.

In the embodiment, the flavor source 132 is a tobacco source added with a basic substance. A pH of an aqueous solution obtained by adding ten times of weight of water to the tobacco source is preferably greater than 7, and more preferably 8 or more. This makes it possible to efficiently take out the flavoring component generated from the tobacco source, by aerosol. This can suppress the amount of the tobacco source in giving a desired amount of the flavoring component to aerosol. On the other hand, the pH of the aqueous solution obtained by adding ten times of weight of water to the tobacco source is preferably 14 or less, and more preferably 10 or less. This can prevent damage (such as corrosion) to the flavor inhaler 100 (e.g., the cartridge 130 or the inhaler body 110).

It should be noted that the flavoring component generated from the flavor source 132 is conveyed by aerosol, and the flavor source 132 itself does not need to be heated.

The mesh 133A is provided so as to close an opening of the cartridge body 131 on the non-inhalation side with respect to the flavor source 132, and the filter 133B is provided so as to close the opening of the cartridge body 131 on the inhalation side with respect to the flavor source 132. The mesh 133A has roughness of a degree not to be passed by the raw material piece composing the flavor source 132. The roughness of the mesh 133A has a mesh opening of, for example, 0.077 mm or more to 0.198 mm or less. The filter 133B is made of a permeable material. The filter 133B is preferably an acetate filter, for example. The filter 133E has roughness of a degree not to be passed by the raw material piece composing the flavor source 132. Here, it should be noted that the filter 133B is provided on the inhalation side from the atomizing unit 111 on the flow path of aerosol generated by the atomizing unit 111.

(Configuration of Heating Element)

Figure 3:
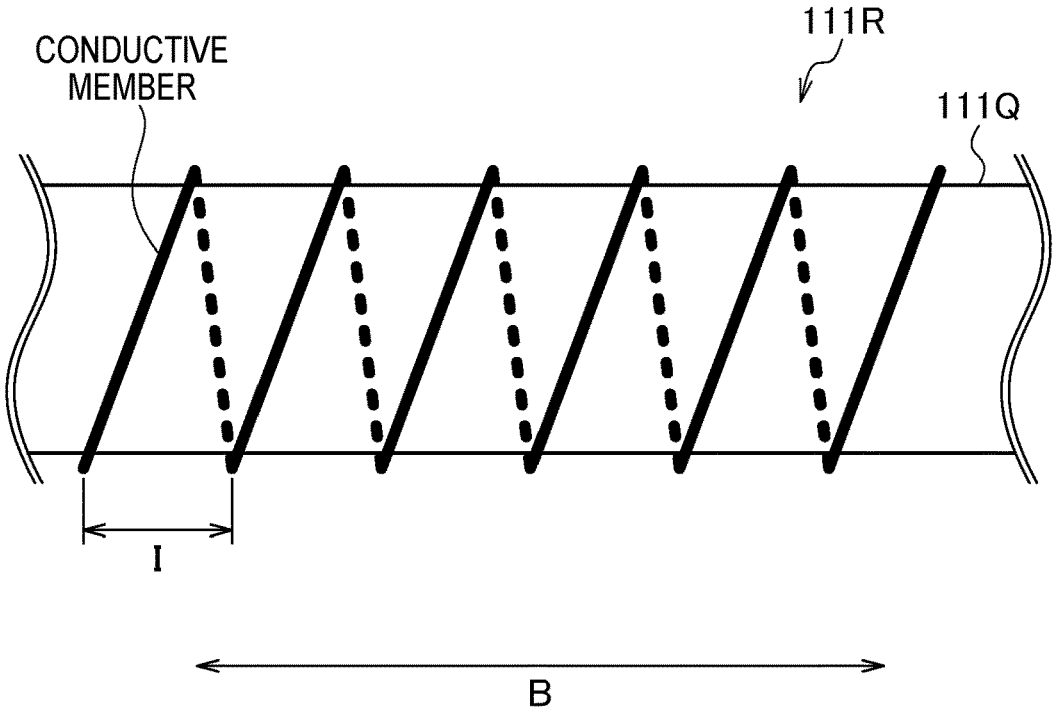
FIG. 3 is a view showing a heating element (atomizer 111R) according to the embodiment.
Figure 4:
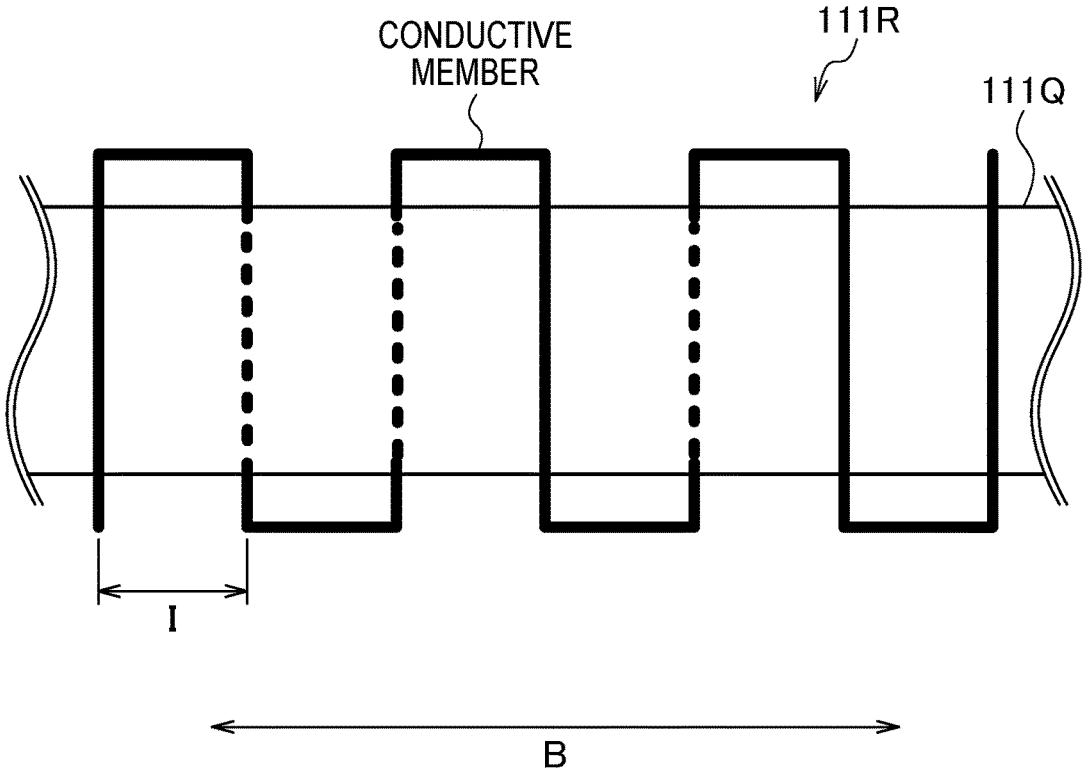
FIG. 4 is a view showing the heating element (atomizer 111R) according to the embodiment.

Hereinafter, the heating element (atomizer 111R) according to the embodiment will be described. FIGS. 3 and 4 are views showing the heating element (atomizer 111R) according to the embodiment. It should be noted that, in FIGS. 3 and 4, only a heater portion of the atomizer 111R is shown.

As shown in FIGS. 3 and 4, the heater portion of the atomizer 111R has a heater shape in which a conductive member forming the heating element extends along the predetermined direction B while being bent. The predetermined direction B is, for example, a direction in which the wick 111Q in contact with or close to the heating element extends. As described above, the oxide film is formed on the surface of the heating element (conductive member).

As shown in FIG. 3, the heater shape may be a shape (coil shape) in which the conductive member extends along the predetermined direction B while being bent in a spiral shape. Alternatively, as shown in FIG. 4, the heater shape may be a shape in which the conductive member extends along the predetermined direction B while being bent in a wave shape (here, a rectangular wave shape).

Here, an interval I between mutually adjacent conductive members among the conductive members forming the heating element is 0.5 mm or less. The interval I is preferably 0.4 mm or less, and more preferably 0.3 mm or less. Here, it should be noted that the interval I is a distance between the conductive members mutually adjacent in the predetermined direction B. "Mutually adjacent" means that the conductive members formed with the oxide film are adjacent to each other in a state where no other member (e.g., the wick 111Q) exists between the conductive members formed with the oxide film.

In the embodiment, the heating element preferably includes a resistance heating element such as a metal. The metal forming the heating element is, for example, one or more metals selected from nickel alloy, chromium alloy, stainless steel, and platinum rhodium.

[Manufacturing Method]

Figure 5:
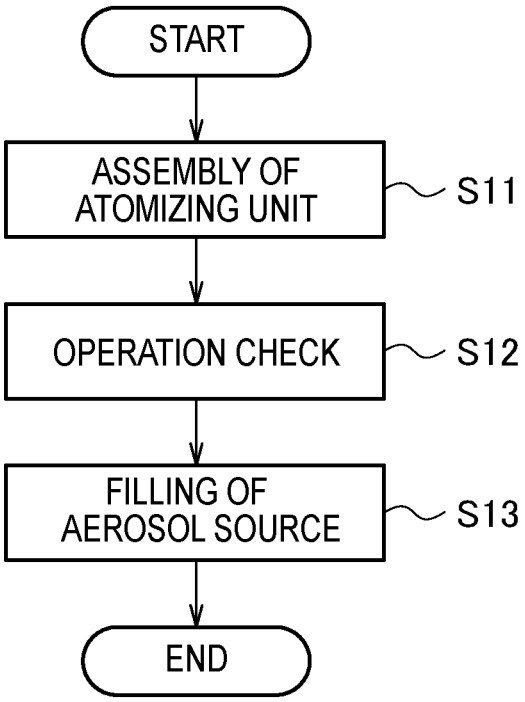
FIG. 5 is a flowchart showing a manufacturing method for the atomizer 111R according to the embodiment.

Hereinafter, a manufacturing method for an atomizing unit according to the embodiment will be described. FIG. 5 is a flowchart showing the manufacturing method for the atomizing unit 111 according to the embodiment.

As shown in FIG. 5, in step S11, the atomizing unit 111 configured by the reservoir 111P, the wick 111Q, and the atomizer 111R is assembled. For example, step S11 includes a step (step B) of bringing the wick 111Q into contact with or close to the atomizer 111R (heating element), and includes a step of disposing the reservoir 111P, the wick 111Q, and the atomizer 111R in the first cylinder 111X. Step S11 may include a process of disposing the tubular member 111S in the first cylinder 111X, in addition to the reservoir 111P, the wick 111Q, and the atomizer 111R. For example, step S11 may include a process of bringing the wick 111Q into contact with the reservoir 111P. Step S11 may include a process of arranging the wick 111Q so as to traverse the airflow path 111T. Step S11 may include a process of taking out one end (here, both ends) of the wick 111Q outside the tubular member 111S.

Here, the atomizer 111R is formed by the heating element processed into the heater shape. As shown in FIG. 3, the heater shape may be the spiral shape (coil shape), or the wave shape as shown in FIG. 4.

In step S12, the oxide film is formed on the surface of the heating element by supplying electric power to the heating element in the state where the heating element is processed into the heater shape (step A). In detail, step S12 is performed in a state where the wick 111Q is in contact with or close to the atomizer 111R (heating element). In the embodiment, step S12 is preferably performed in an air atmosphere.

In the embodiment, step S12 is a process of checking an operation of the atomizing unit 111. A condition for checking the operation of the atomizing unit 111 is, for example, a condition simulating an aspect of supplying electric power to the heating element in accordance with a user's inhalation action. In step S12, electric power may be supplied to the heating element with air flowing in the airflow path 111T to simulate the user's inhalation action.

The condition for checking the operation of the atomizing unit 111 is, for example, a condition for performing processing of applying same voltage as the power source mounted on the flavor inhaler 100 to the heating element over 1.5 to 3.0 seconds for m times (m is an integer of 1 or more). Here, m is preferably 5 or more, and more preferably 10 or more. The same voltage as the power source mounted on the flavor inhaler 100 is a nominal voltage of the battery constituting the power source. For example, when the power source is a lithium-ion battery, the voltage applied to the heating element is about 3.7, and when the power source is a nickel metal hydride battery, the voltage is about 1.2 V. When multiple batteries are connected in series, the voltage applied to the heating element is an integral multiple of the nominal voltage.

Here, the interval of the processing of applying the voltage to the heating element is preferably 5 seconds or more, more preferably 15 seconds or more, and most preferably 30 seconds or more. This reduces temperature of the heating element in the interval of processing of applying the voltage to the heating element, preventing excessive high temperature of the heating element in the processing of applying the voltage to the heating element. On the other hand, the interval of the processing of applying the voltage to the heating element is preferably 120 seconds or less, and more preferably 60 seconds or less. This allows processing of forming the oxide film on the surface of the heating element to be performed in a short time.

In step S13, the aerosol source is filled in the reservoir 111P. Step S13 may include a step of attaching a cap to the reservoir 111P, to prevent leakage of the aerosol source after filling of the aerosol source. That is, after assembly of the atomizing unit 111, the cap may be attached along with the filling of the aerosol source. After the atomizing unit 111 is completed in step S13, an assembly process of the flavor inhaler 100 is performed. However, when the atomizing unit 111 is distributed in a state not incorporated in the flavor inhaler 100, the assembly process of the flavor inhaler 100 may be omitted.

In the embodiment, the step S12 is preferably performed before the aerosol source is filled in the reservoir 111P, after assembly of the atomizing unit 111. For example, step S12 may be performed in a state where the heating element is neither in contact with nor close to the aerosol source. Step S12 may be performed with the wick 111Q being in contact with the reservoir 111P. Step S12 may be performed in a state where the wick 111Q traverses the airflow path 111T. Step S12 may be performed in a state where one end (here, both ends) of the wick 111Q is taken outside the tubular member 111S. When the heating element has the spiral shape (coil shape) shown in FIG. 3, step S12 may be performed in a state where the heating element is wound around the wick 111Q.

The state where the heating element is neither in contact with nor close to the aerosol source means a state where the distance between the heating element and the aerosol source is not maintained to such an extent that the heating element can atomize the aerosol source. The distance between the heating element and the aerosol source depends on a type of the aerosol source and the wick 111Q, temperature of the heating element, and the like. For example, a distance greater than 1 mm, preferably greater than 3 mm may be considered. Furthermore, the state where the heating element is neither in contact with nor close to the aerosol source may be a state where the heating element is in contact with or close to the wick 111Q, but the wick 111Q does not hold the aerosol source.

(Function and Effect)

In the manufacturing method for the atomizing unit 111 according to the embodiment, the oxide film is formed on the surface of the heating element by supplying electric power to the heating element in the state where the heating element is processed into the heater shape. Accordingly, while reducing the interval between the mutually adjacent conductive members among the conductive members forming the heating element, it is possible to prevent short-circuit of the conductive members forming the heating element by the oxide film formed on the surface of the heating element. Furthermore, as compared with the case where the heating element is processed into the heater shape after the oxide film is formed on the surface of the heating element, it is easy to prevent peeling of the oxide film formed on the surface of the heating element.

In the embodiment, step S12 is performed in the state where the heating element is neither in contact with nor close to the aerosol source. This prevents heat loss due to atomization of the aerosol source, and allows the oxide film to be easily formed uniformly on the surface of the heating element.

In the embodiment, step S12 is performed in the state where the heating element is in contact with or close to the wick 111Q. As compared with a case where the heating element is brought into contact with or close to the wick 111Q after the oxide film is formed on the surface of the heating element, it is easy to prevent peeling of the oxide film formed on the surface of the heating element.

In the embodiment, step S12 is the process of checking the operation of the atomizing unit 111, as a part of a manufacturing process of the flavor inhaler 100. Therefore, it is possible to form the oxide film on the surface of the heating element without adding a new process to the manufacturing process of the flavor inhaler 100.

In the atomizing unit 111 according to the embodiment, the oxide film is formed on the surface of the heating element. Accordingly, while reducing the interval I between the mutually adjacent conductive members among the conductive members forming the heating element, it is possible to prevent short-circuit of the conductive member forming the heating element by the oxide film formed on the surface of the heating element.

In the embodiment, the interval I between the mutually adjacent conductive members among the conductive members forming the heating element is 0.5 mm or less. Assuming that the power output (e.g., voltage) for the heating element is constant, the aerosol amount per unit power output is increased.

In the embodiment, the filter 133B is provided on the inhalation side from the atomizing unit 111 on the airflow path 111T. Therefore, even if the oxide film formed on the surface of the heating element is peeled, the oxide film piece peeled from the surface of the heating element is captured by the filter 133B.

In the embodiment, step S12 is performed after assembly of the atomizing unit 111. Therefore, as compared with a case where the atomizing unit 111 is assembled after the oxide film is formed on the surface of the heating element, it is easy to prevent peeling of the oxide film formed on the surface of the heating element.

Other Embodiments

Although the present invention has been described with the above-described embodiments, the descriptions and drawings forming a part of the disclosure should not be construed as limiting the present invention. From this disclosure, various alternative embodiments, examples, and operation techniques will be apparent to those skilled in the art.

In the embodiment, the case has been exemplified where the process (step A) of forming the oxide film on the surface of the heating element is the process of checking the operation of the atomizing unit 111. However, the embodiment is not limited to this. The process (step A) of forming the oxide film on the surface of the heating element may be performed before assembly of the atomizing unit 111 configured by the reservoir 111P, the wick 111Q, and the atomizer 111R. However, the process (step A) of forming the oxide film on the surface of the heating element is preferably performed in the state where the heating element is neither in contact with nor close to the aerosol source.

The case has been exemplified where the process (step A) of forming the oxide film on the surface of the heating element is the process of checking the operation of the atomizing unit 111. However, the embodiment is not limited to this. The process (step A) of forming the oxide film on the surface of the heating element may include a step of intermittently supplying electric power to the heating element. A condition for intermittently supplying electric power to the heating element may be different from the condition for checking the operation of the atomizing unit 111, as long as the oxide film can be formed on the surface of the heating element. This prevents excessive high temperature of the heating element in the processing of supplying electric power to the heating element.

In the embodiment, the case has been exemplified where the process (step A) of forming the oxide film on the surface of the heating element is performed in an air atmosphere. However, the embodiment is not limited to this. For example, the process (step A) of forming the oxide film on the surface of the heating element may be performed in a state where the heating element is in contact with an oxidizing substance. The oxidizing substance may be any substance capable of forming the oxide film on the surface of the heating element. The oxidizing substance is preferably liquid having a boiling point equal to or higher than the temperature of the heating element, which is increased by supply of electric power to the heating element. The oxidizing substance is, for example, concentrated nitric acid, hydrogen peroxide, or the like. For example, in a case where step S12 is performed in the state where the heating element is in contact with the oxidizing substance, the temperature of the heating element, which is increased by supply of electric power to the heating element, is 40° or more and less than the boiling point of the oxidizing substance. This can reduce an amount of power to be supplied to the heating element in the process of forming the oxide film on the surface of the heating element, and allows the oxide film to be formed on the surface of the heating element even in a low temperature of the heating element.

In the embodiment, the cartridge 130 does not include the atomizing unit 111, but the embodiment is not limited to this. For example, the cartridge 130 may form one unit in combination with the atomizing unit 111.

Although not specifically mentioned in the embodiment, the atomizing unit 111 may be configured to be connectable to the inhaler body 110.

Although not specifically mentioned in the embodiment, the flavor inhaler 100 may not have the cartridge 130. In such a case, the aerosol source preferably contains a flavoring component.

In the embodiment, only one configuration example of the atomizing unit 111 has been described. Therefore, the configuration of the atomizing unit 111 is not particularly limited. For example, step S12 of forming the oxide film on the surface of the heating element may be performed after assembly of a unit including at least the reservoir 111P, the wick 111Q, and the atomizer 111R.

In the embodiment, as the heater portion of the atomizer 111R, the heating element has been exemplified, which is in a spiral shape or a wave shape arranged along an outer periphery of the wick 111Q as illustrated in FIGS. 3 and 4. However, the embodiment is not limited to this. For example, the wick II IQ may be brought into contact with or close to the heating element by covering the coil-shaped or wave-shaped heating element with the wick 111Q having a tubular shape.

INDUSTRIAL APPLICABILITY

According to the embodiment, it is possible to provide the method for manufacturing the atomizing unit the atomizing unit, and the non-combustion type flavor inhaler that can prevent short-circuit of the conductive member forming the heating element in the manufacturing process for the heating element.

The invention claimed is:

1. A method for manufacturing an atomizing unit, comprising the steps of:

a step A of forming an oxide film on a surface of a heating element forming a part of an atomizing unit that atomizes an aerosol source, by supplying electric power to the heating element, in a state where the heating element is processed into a heater shape; and a step B of bringing a liquid holding member into contact with or close to the heating element, the liquid holding member being a member to hold the aerosol source, wherein the step A is performed in a state where the liquid holding member is in contact with or close to the heating element, and wherein the liquid holding member is a separate component from the oxide film.

2. The method for manufacturing the atomizing unit according to claim 1, wherein the step A is performed in a state where the heating element is neither in contact with nor close to the aerosol source.

3. The method for manufacturing the atomizing unit according to claim 1, wherein the step A is performed in a state where the liquid holding member is in contact with a reservoir that is a member to store the aerosol source.

4. The method for manufacturing the atomizing unit according to claim 3, wherein the step A is performed before the aerosol source is filled in the reservoir.

5. The method for manufacturing the atomizing unit according to claim 1, wherein the liquid holding member has a heat conductivity of 100 W/(m·K) or less.

6. The method for manufacturing the atomizing unit according to claim 1, wherein:

the liquid holding member is made of a material having flexibility; and the heater shape is a shape of the heating element wound around the liquid holding member, and is a coil shape.

7. The method for manufacturing the atomizing unit according to claim 1, wherein the step A is performed in a state where the liquid holding member traverses an airflow path including a flow path of aerosol generated from the atomizing unit.

8. The method for manufacturing the atomizing unit according to claim 7, wherein the step A is performed in a state where at least one end of the liquid holding member is taken outside a tubular member forming the airflow path.

9. The method for manufacturing the atomizing unit according to claim 1, wherein the step A is performed in a state where the heating element is in contact with an oxidizing substance.

10. The method for manufacturing the atomizing unit according to claim 1, wherein the step A includes a step of supplying electric power to the heating element in accordance with a condition for checking an operation of the atomizing unit.

11. The method for manufacturing the atomizing unit according to claim 10, wherein the condition is a condition that a process is performed for m times (m is an integer of 1 or more), the process applying a voltage to the heating element over 1.5 to 3.0 seconds, the voltage being a same voltage as a power source mounted on a non-combustion type flavor inhaler incorporated with the atomizing unit.

12. The method for manufacturing the atomizing unit according to claim 1, wherein the step A includes a step of intermittently supplying electric power to the heating element.

* * * * *